US007740490B1

(12) United States Patent
Chang

(10) Patent No.: US 7,740,490 B1
(45) Date of Patent: Jun. 22, 2010

(54) CONNECTOR WITH STORAGE FUNCTION

(76) Inventor: Nai-Chien Chang, 5F., No. 15, Lane 117, Sec. 4, Sanhe Rd., Sanchong City, Taipei County 241 (TW)

( * ) Notice: Subject to any disclaimer, the term of this patent is extended or adjusted under 35 U.S.C. 154(b) by 0 days.

(21) Appl. No.: 12/619,788

(22) Filed: Nov. 17, 2009

(30) Foreign Application Priority Data

Dec. 22, 2008 (TW) ..... 97223001 U

(51) Int. Cl.
*H01R 12/00* (2006.01)

(52) U.S. Cl. ..... 439/76.1; 439/607.4; 439/620.12; 439/620.16; 439/620.19

(58) Field of Classification Search ..... 439/76.1, 439/607.01, 607.4, 620.1, 620.11, 620.12, 439/620, 16, 620.19, 660
See application file for complete search history.

(56) References Cited

U.S. PATENT DOCUMENTS 6,450,837 B1 * 9/2002 Givens et al. ..... 439/620.19
6,537,110 B1 * 3/2003 Korsunsky et al. ..... 439/676
6,568,966 B1 * 5/2003 Korsunsky et al. ..... 439/676
7,625,245 B1 * 12/2009 Yao ..... 439/660

* cited by examiner

*Primary Examiner*—Tho D Ta
(74) *Attorney, Agent, or Firm*—Chun-Ming Shih

(57) ABSTRACT

A connector with storage function includes a housing, a seat body, a terminal group, a storage module, and a cover. The housing has a receptacle at a front end, and an opening at a rear end. The seat body is disposed in the housing, and includes a block. The block has a supporting portion and a plurality of slots. The terminal group is disposed on the supporting portion and in the slot. The terminal group further includes a hollow opening at a rear end. The storage module electrically connects with the terminal group, and has a printed circuit board disposed thereon. The printed circuit board electrically connects with a storage unit. The cover has a first cover and a second cover and is disposed in the hollow opening of the seat body. The connector not only stores data required by electronic product, but also increases storage capacity of the electronic product.

9 Claims, 4 Drawing Sheets

CONNECTOR WITH STORAGE FUNCTION

BACKGROUND

1. Field of the invention

The present invention relates to a connector, and more particularly, to a connector with storage function.

2. Description of the Related Art

Electrical connectors refer to all the connecting elements and its accessories applied to electronic products and power supplies. For example, electrical connectors are required between computers and its periphery equipments such as mouse, display, keyboard, printer, and so on. Furthermore, electrical connectors are also required for transforming electric signals between different modules of electronic devices, such as IC connector, board edge connector, and so on. Thus, electrical connectors are most important accessories for electrical products.

Recently, with developments of science and technology, many kinds of new electrical connectors are manufactured, such as USB, HDMI, Displayport, eSATA, SATA. In one aspect, some of the electrical connectors may simplify multiple data lines and improve transmission rate. For example, in the past, at least three date lines are needed during transmitting voice and image, and now, only one HDMI is able to transmit voice and image. In another aspect, some of the electrical connectors of multiple functions may be superposed or joined together to form a multiport electrical connector, making a single multiport electrical connector able to receive multiple data lines of different functions.

Because the forgoing electrical connectors are used for simplifying external wire rod twisting of electronic products, solving data transmission rate and capable of receiving multiple data lines, but could not store data of the electronic product and therefore increasing storage capacity of the electronic product.

BRIEF SUMMARY

The main purpose of the present invention is to solve such problems. The present invention provides a connector with storage function, which is formed of joining a storage module and an electrical connector together, the connector not only stores data required by an electronic product, but also increases storage capacity of the electronic product.

For acquiring such purpose, the present invention provides a connector with storage function, the connector includes:

a housing being of a hollow body, having a receptacle at a front end, and an opening at a rear end;

a seat body disposed in the housing, the seat body having a block and the block having a supporting portion extending into the receptacle, the block has a plurality of slots, and a hollow opening at a rear end;

a terminal group composed of a plurality of conductive legs, each of the conductive legs having a first step and a second step, the first step being disposed on the supporting portion, the second step being disposed in the slot and extending into the hollow opening;

a storage module electrically connected with the terminal group, and having a printed circuit board disposed thereon, the printed circuit board electrically connecting with a storage unit, the printed circuit board having a plurality of sockets at an end for receiving the second steps, and a plurality of pins at the other end for electrically connecting; and a cover being of an L-shaped body made of plastic, and including a first cover and a second cover, the first cover defining a plurality of through holes, allowing the pins passing through, the first cover having two protrusions at opposite sides for joining with the indentations.

Therefore, memory design of the printed circuit board is not required, and the area of the printed circuit board is decreased, or the storage capacity of the electronic product is increased.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
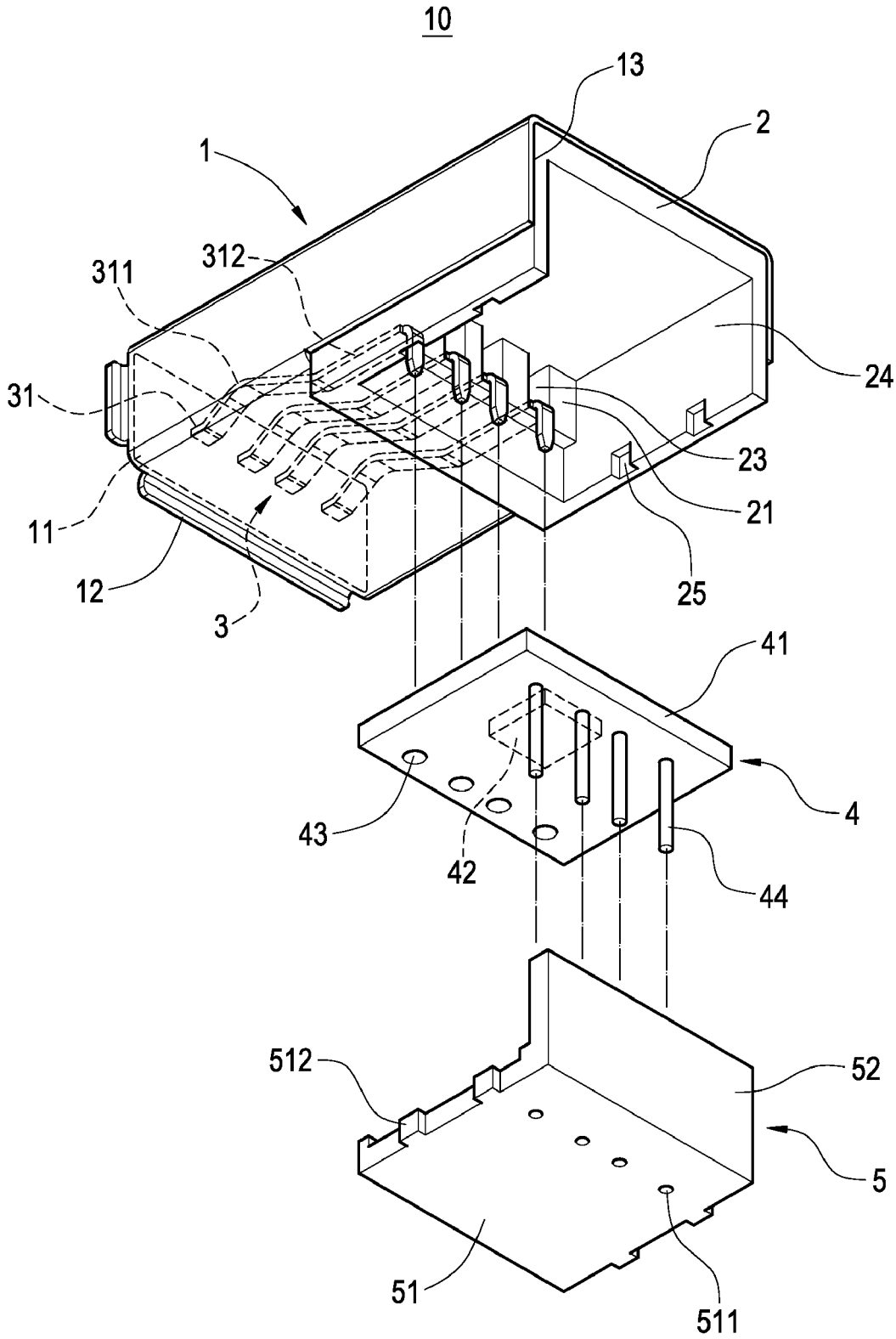
FIG. 1 is a schematic, exploded view of a connector of one embodiment of the present invention.
Figure 2:
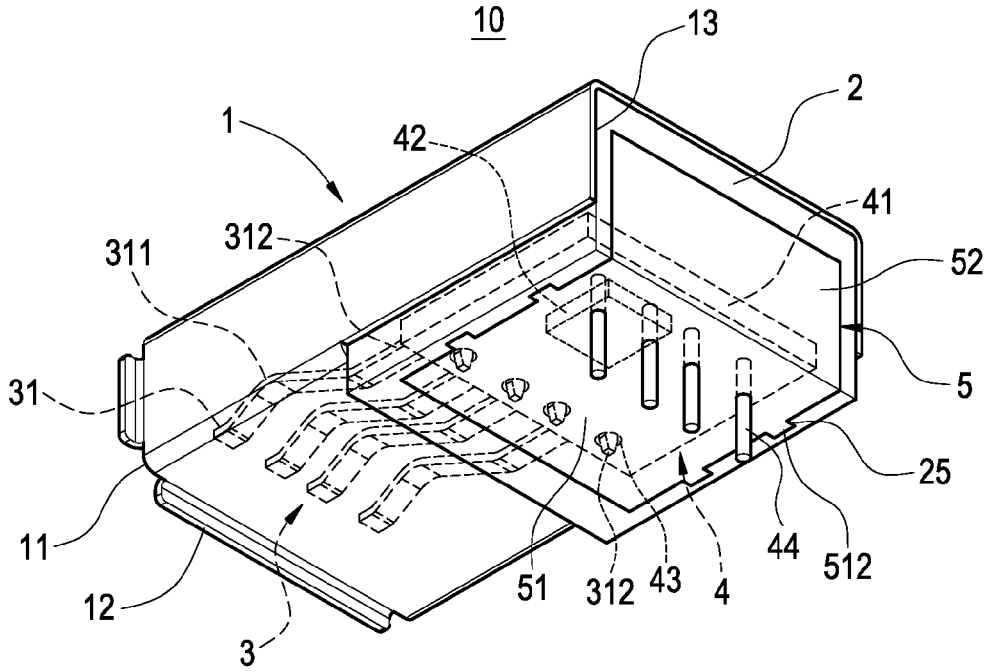
FIG. 2 is a bottom, assembled view of the connector of the present invention.
Figure 3:
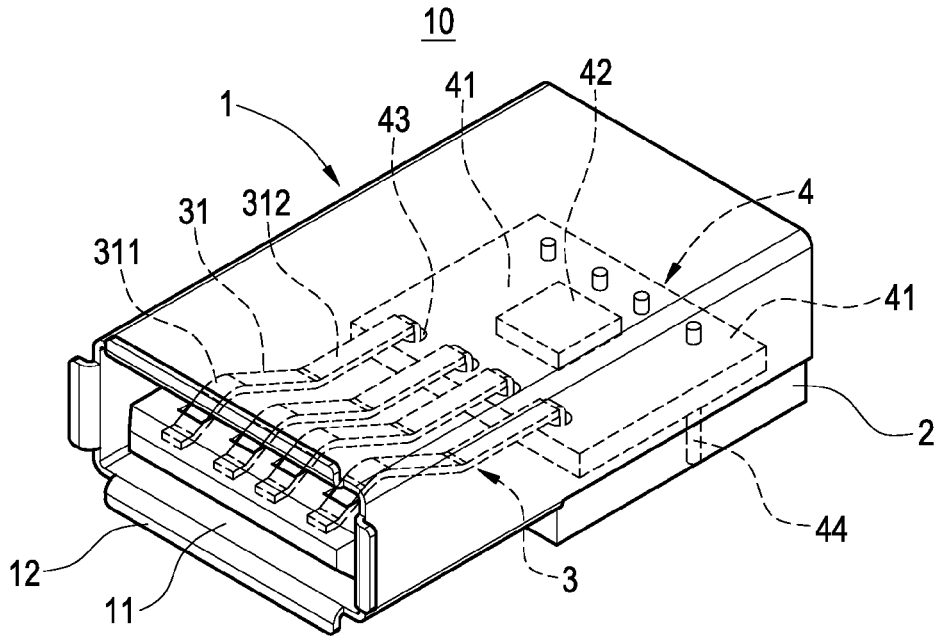
FIG. 3 is an assembled view of the connector of the present invention, but viewed from another aspect.
Figure 4:
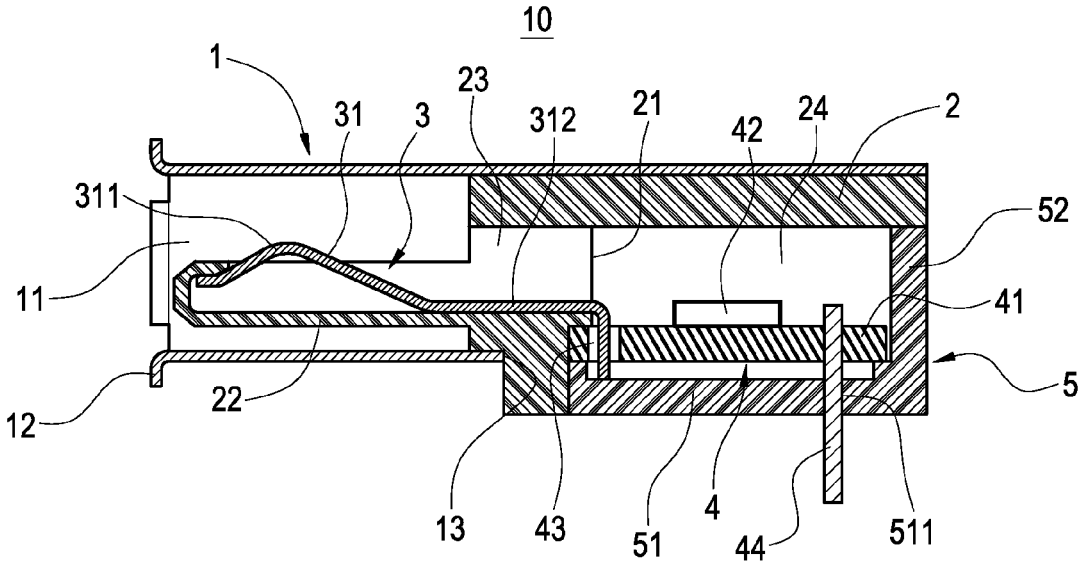
FIG. 4 is a side cross sectional view of the connector of the present invention.

FIG. 1 is a schematic, exploded view of a connector of one embodiment of the present invention. FIG. 2 is a bottom, assembled view of the connector of the present invention. FIG. 3 is an assembled view of the connector of the present invention, but viewed from another aspect. FIG. 4 is a side cross sectional view of the connector of the present invention. Referring to FIGS. 1 to 4, the connector 10 of the present invention includes a housing 1, a seat body 2, a terminal group 3, a storage module 4 and a cover 5.

The housing 1 is a hollow body made of metal. The housing 1 has a receptacle 11 at a front end. A periphery of the receptacle 11 has a plurality of arc-shaped baffle plates 12. The housing 1 has an opening 13 at a rear end.

The seat body 2 is made of plastic material and is disposed in the housing 1. The seat body 2 has a block 21 and the block 21 extends a supporting portion 22. The supporting portion 22 is disposed in the receptacle 11. The block 21 defines a plurality of slots 23, allowing the terminal group 3 passing through with corresponding ends of conductive legs 31 of the terminal group 3 extending on the supporting portion 22. The seat body 2 has a hollow opening 24 at a rear end. Two indentations 25 are formed at opposite sidewalls of the hollow opening 24.

The terminal group 3 is composed of a plurality of conductive legs 31. Each of the conductive legs 31 has a first step 311 and a second step 312. The first step 311 is in arc profile and is disposed on the supporting portion 22. The second step 312 is L-shaped and is disposed in the slot 23, and further extends into the hollow opening 24.

The storage module 4 has a printed circuit board 41 disposed thereon. The printed circuit board 41 electrically connects with a storage unit 42. The printed circuit board 41 has a plurality of sockets 43 at an end, and a plurality of pins 44 at the other end. The sockets 43 are used for receiving the second steps 312, making the terminal group 3 electrically connect with the printed circuit board 41. It is noted that the storage unit 42 is a memory in this embodiment.

The cover 5 is an L-shaped body made of plastic material, and includes a first cover 51 and a second cover 52. The first cover 51 defines a plurality of through holes 511, allowing the pins 44 passing through. The first cover 51 has two protrusions 512 at opposite sides for joining with the indentations 25. When the cover 5 is disposed in the hollow opening 24, the pins 44 pass through the through holes 511 of the first cover 51, making the protrusions 512 of the first cover 51 be received in the indentations 25.

FIG. 4 is a side cross sectional view of the connector of the present invention. Referring to FIG. 4, after the connector 10 is assembled, the connector 10 has a storage module 4 built therein for storing data. The connector 10 connected with the storage module 4 may be selected from USB, HDMI, Displayport, PS/2, eSATA, micro-USB, MINI USB, or IEEE1394.

Figure 5:
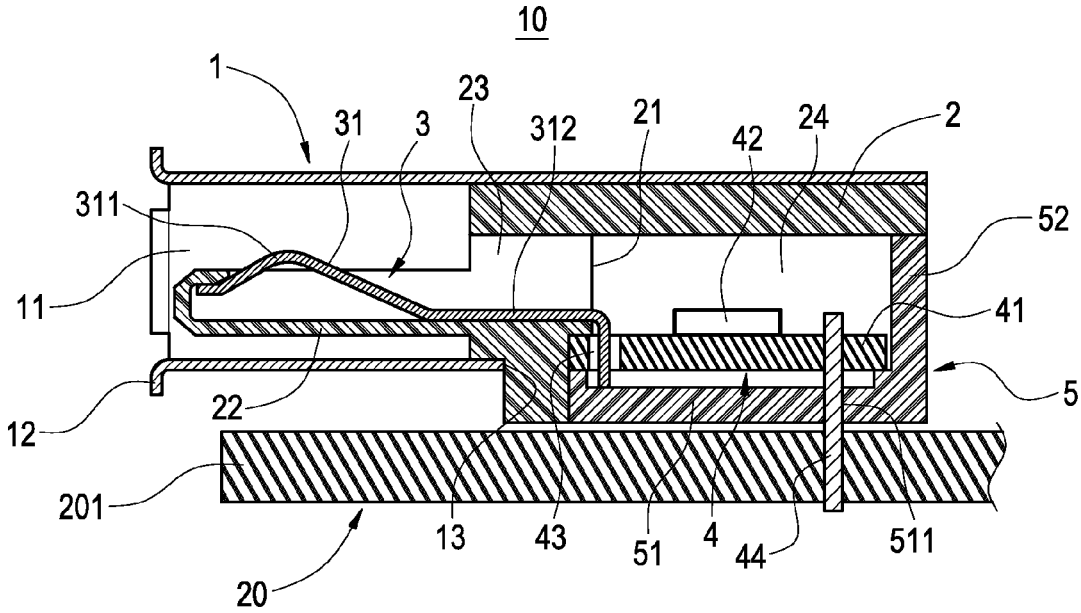
FIG. 5 is a side cross sectional view of the connector and an electronic device of the present invention.
Figure 6:
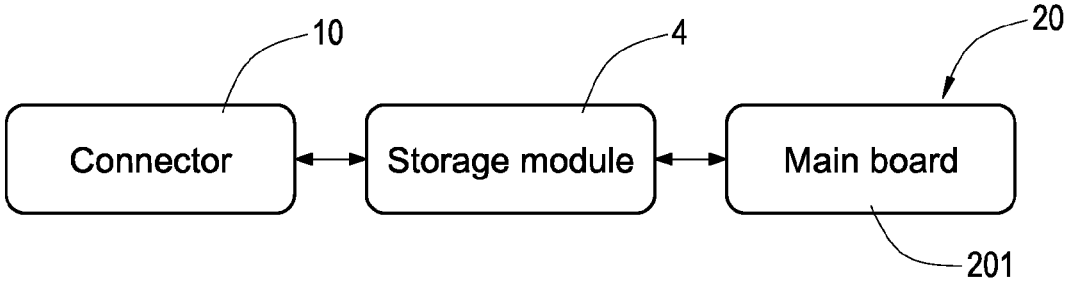
FIG. 6 is a block diagram showing an electrical connection between the connector and an electronic product.

FIG. 5 is a side cross sectional view of the connector and an electronic device of the present invention. FIG. 6 is a block diagram showing an electrical connection between the connector and an electronic product. Referring to FIGS. 5 and 6, after the pins 44 of the connector 10 electrically connects with the main board 201 of the electronic product 20, the storage unit 42 of the storage module 4 forms as a built-in memory of the electronic product 20 for storing data required by the electronic product 20. Also, the connector 10 may be electrically connected with a data line or a portable disk (not shown) through the receptacle 11, for storing external data into the storage unit 42.

For the forgoing reasons, memory design of the printed circuit board is not required, and the area of the printed circuit board is decreased, or the storage capacity of the electronic product is increased.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A connector with storage function electrically connected with an electronic product for storing date, comprising:

a housing being of a hollow body, having a receptacle at a front end, and an opening at a rear end;

a seat body disposed in the housing, the seat body having a block and the block having a supporting portion extending into the receptacle, the block having a plurality of slots, and a hollow opening at a rear end;

a terminal group disposed on the supporting portion and in the slot of the block;

a storage module electrically connected with the terminal group and having a plurality of pins for electrically connecting with the electronic product; and a cover, being an L-shaped body made of plastic, and including a first cover and a second cover, the first cover defining a plurality of through holes, allowing the pins passing through, the first cover having two protrusions at opposite sides for joining with two indentations of the seat body.

2. The connector according to claim 1, wherein the housing is made of metal.

3. The connector according to claim 1, wherein a periphery of the receptacle has a plurality of arc-shaped baffle plates.

4. The connector according to claim 1, wherein the seat body is made of plastic material.

5. The connector according to claim 1, wherein two indentations are formed at opposite sidewalls of the hollow opening.

6. The connector according to claim 1, wherein the connector is selected from USB, HDMI, Displayport, PS/2, eSATA, micro-USB, MINI USB, or IEEE1394.

7. The connector according to claim 1, wherein the terminal group is composed of a plurality of conductive legs, each of the conductive legs has a first step and a second step, the first step is disposed on the supporting portion, the second step is disposed in the slot and extends into the hollow opening.

8. The connector according to claim 7, wherein the storage module has a printed circuit board disposed thereon, the printed circuit board electrically connects with a storage unit, the printed circuit board has a plurality of sockets at an end, and the plurality of pins at the other end for electrically connecting.

9. The connector according to claim 8, wherein the storage unit is a memory.

* * * * *